United States Patent [19]

Cleary et al.

[11] Patent Number: 4,563,936

[45] Date of Patent: Jan. 14, 1986

[54] WEAPON WITH NEXT ROUND SELECT FEED SYSTEM

[75] Inventors: Michael M. Cleary, Pacific Palisades; Luis A. Bohorquez, Inglewood, both of Calif.

[73] Assignee: Hughes Helicopters, Inc., Culver City, Calif.

[21] Appl. No.: 383,149

[22] Filed: May 28, 1982

[51] Int. Cl.[4] ..... F41D 10/32; F41F 9/00

[52] U.S. Cl. ..... 89/11; 89/33.25; 89/33.04

[58] Field of Search ..... 89/33 SF, 33 BA, 33 CA, 89/33 BC, 11, 14.1

[56] References Cited

U.S. PATENT DOCUMENTS

| | | | |
|---|---|---|---|
| 1,329,903 | 2/1920 | Hewitt | 89/14.1 |
| 3,410,381 | 11/1968 | Henshaw et al. | 89/33 BA |
| 3,741,069 | 6/1973 | Stewart et al. | 89/33 CA |
| 3,869,960 | 3/1975 | Clark | 89/33 CA |
| 4,015,511 | 4/1977 | Folsom et al. | 89/33 CA |
| 4,119,012 | 10/1978 | Frye | 89/33 CA |
| 4,244,270 | 1/1981 | Tassie | 83/33 CA |
| 4,301,709 | 11/1981 | Bohurquez et al. | 89/11 |
| 4,305,326 | 12/1981 | Sallach et al. | 89/33 CA |
| 4,328,737 | 5/1982 | Nelson et al. | 89/33 CA |
| 4,373,422 | 2/1983 | Washburn et al. | 89/33 CA |

*Primary Examiner*—Stephen C. Bentley
*Assistant Examiner*—John S. Maples
*Attorney, Agent, or Firm*—Beehler, Pavitt, Siegemund, Jagger & Martella

[57] ABSTRACT

An improvement is made in an externally driven gun having an ammunition feeder capable of providing at least two types of ammunition to the gun by incorporating a gear transmission into the driving mechanism coupled to the ammunition feeder to appropriately control an in-feed sprocket within the ammunition feeder so that the ammunition type can be changed prior to commitment of the previously selected type of ammunition to the firing mechanism of the gun. The gear transmission which is coupled to the in-feed sprocket provides acceleration to the sprocket at the last possible moment prior to handing-off the round to the firing mechanism. In one embodiment the gear transmission includes a cam follower rotatably coupled about an offset axis to the input shaft and coupled to the output shaft through a radial slot. The cam follower is rotated by means of a stationary cam race as the follower itself is rotated as a whole by the input shaft. The output shaft is coupled to the cam follower by a pin extending into the radial slot. In a second embodiment, the gear transmission includes a planet gear rotatably coupled to the input shaft about an offset axis and engaging a stationary ring gear. A slider is provided about an offset axis on the planet gear and engages a radially defined slot in the output shaft. Both embodiments convert a substantially uniform angular velocity into an oscillating angular velocity to effect the desired acceleration of the in-feed sprocket.

16 Claims, 14 Drawing Figures

73
71
58
72
74
68
59
61
200
64
60
40
37
35
21

17
85
85
60
60a
85
18
85
87
37

RECOIL
FIRE
LOCK
UNLOCK
100
105
107
110
115
116
118
120
121
125
127
129
31
208

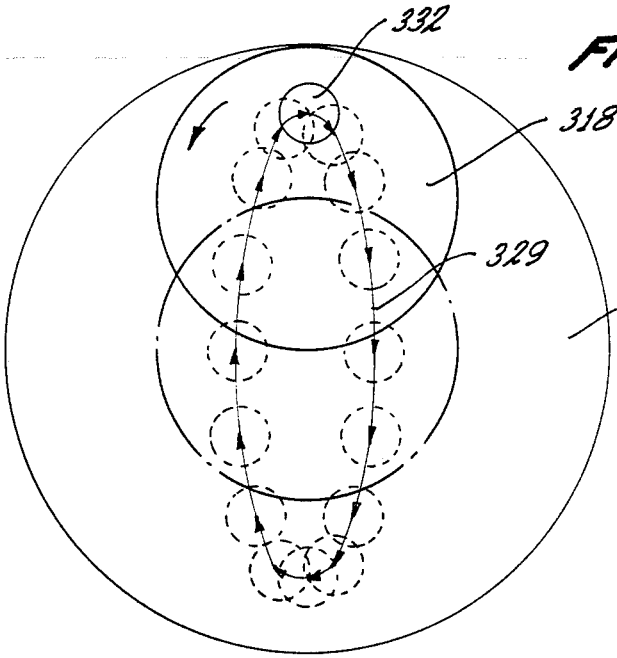
FIG. 10A
FIG. 8A
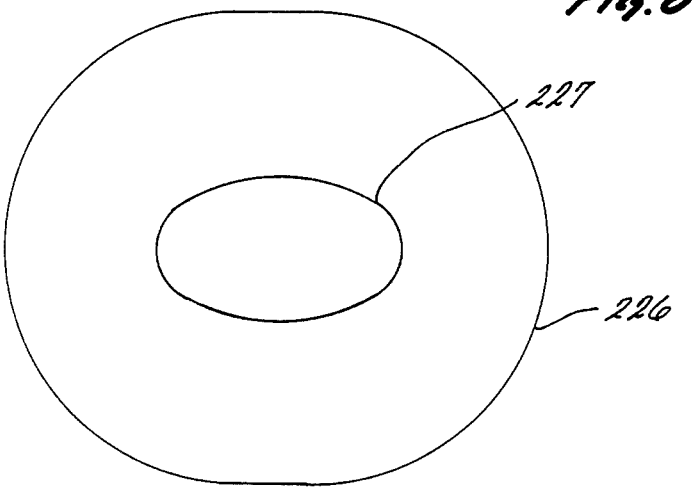

WEAPON WITH NEXT ROUND SELECT FEED SYSTEM

BACKGROUND OF THE INVENTION

1. Field of the Invention

This invention relates to a weapon with a relatively high rate of fire and more particularly to an improved weapon having a dual feed mechanism which permits an instantaneous next round selection when switching from one feed mechanism to the other.

2. Description of the Prior Art

Relatively high rate of fire weapons are known which have a single feed mechanism, for example the gun described in U.S. application Ser. No. 789,502, filed Apr. 21, 1977, which is a continuation of U.S. application Ser. No. 418,356, filed Nov. 23, 1973, and now abandoned, and assigned to the same assignee of the present invention.

Improved versions of the gun of Ser. No. 789,502 are disclosed in U.S. application Ser. Nos. 046,664 and 046,665, both filed on June 8, 1979, and assigned to the same assignee of the present invention.

Among the improvements is the provision of a dual feed mechanism, as disclosed in U.S. application Ser. Nos. 046,664 and 046,665 permitting feeding of the same type of ammunition through one or the other of the feed mechanisms, or permitting feeding of different types of ammunition, one type through each feed mechanism. Where the same type of ammunition is used in each feed mechanism, switching from one feed mechanism to the other creates no noticeable difference in the impact point of the round since the ballistics and the trajectory of the rounds are the same.

Where, however, one feed mechanism feeds one type of round and the other feed mechanism feeds another type of round, there is a one-round delay which may create operational problems if the gunner is not aware of or does not remember to compensate for the differences in ballistics and/or trajectory of the different types of ammunition. In the gun described in U.S. application Ser. Nos. 046,664 and 046,665, if a gunner is firing one type of round, for example 25 mm high explosive incendiary (HEI), and switches to another type of round, for example 25 mm armor piercing discarding sabot (APDS), one round of the previously selected ammunition will cycle and fire before the first round of the newly selected ammunition is fed and fired. Normally, either a fire control or sighting mechanism is used which automatically or manually compensates for the difference in trajectory of the various types of ammunition. Thus, with a target at 1000 meters, and assuming a change from HEI to APDS ammunition, one round of HEI remains to be fired. If before the remaining round of HEI is fired, the gunner compensates for the change in ammunition, the result is that gun elevation is reduced (i.e., compensating super-elevation is reduced), and the remaining HEI round will fall short of the 1000 meter target. Conversely, if the change is made from APDS to HEI, one round of APDS remains to be fired. If at the time of the change, the gunner adds elevation (i.e., compensating super-elevation is added) the APDS round fired will pass above the target.

Accordingly, the gunner must be trained to remember that slighting changes should be made after firing the one remaining round of the previously selected ammunition type. This, however, is not always easy to do under the stress of combat, particularly since the firing mode may have been a rapid fire mode. In this event, the gunner must stop firing, select the other type of ammunition, select the single round mode, fire the remaining round, make the appropriate sighting adjustment, and then select the appropriate firing mode as called for by the operational circumstances.

There are, however, operational circumstances in which it is desired to assure that after a change is made, the fired round of the selected ammunition will be on target. A short round may fall in a friendly zone or a long round may give away the surprise advantage.

To understand why one round of the previously fired type remains to be fired after a change in ammunition types, it is necessary to understand the operation of the guns of the three applications previously identified.

Those prior guns are characterized by a feeder assembly which includes constantly driven in-feed sprockets and an intermittently driven feed rotor. With the gun in the normal cease-fire rest condition, the bolt is to the rear holding the spent casing of the previously fired round. The cooperating feed rotor with the three round pockets is stationary, and a round is in that pocket which is next in the rotor feed sequence. There is also a round in each of the in-feed sprockets. The important point to note is that one live and an empty case are in the feed rotor and irreversibly committed to the firing sequence, one behind the breech and one due to be rotated to the breech position next.

At the start of firing, the motor causes the bolt drive assembly to function as well as the in-feed sprockets. As the master link on the bolt assembly traverses from one side of the chain drive track to the other, the feed rotor is intermittently driven, sweeping out the spent casing and presenting the one round, already in the feed rotor, to the bolt face. At this point, the bolt starts forward, the feed rotor is stationary and the in-feed sprockets remain in motion. The one round is rammed, fired, and the spent casing withdrawn from the breech and brought to the rear, essentially to the "rest position." Just prior to coming to the rest position the next round drops into the feed rotor. At this point the sequence repeats.

From the above brief description, it can be seen that if an ammunition change is made so that the second round is the newly selected ammunition type, there will be one shot fired of the previous ammunition type, with the possible consequences already discussed.

While it is possible to redesign the gun structure in-feed mechanism completely, or to redesign the gun, there are significant practical advantages in being able to provide a next round selection feed system which will assure that the first round will be the selected type, and to achieve this feature without substantial reconstruction of the gun components.

It is also an advantage to be able to simplify the loading and down-loading of the gun, as compared to earlier versions of the same type of gun.

It is known in the prior art to feed a round into a feed sprocket which is driven at a constant rotational velocity, and to use cam operated buckets which are moved radially, through a cam action, to increase the linear velocity of the round as it is handed-off to the gun bolt. In such a system, which is relatively complex, acceleration of the round is achieved by combination of a constant rotational velocity, of a shaft with radial displacement of the feed buckets, which travel at the same angular velocity as the shaft upon which they are mounted.

To use such a system in the dual feed guns described would require substantial redesign of the entire in-feed mechanism.

It would also be an advantage to include in the gun design a feature for avoiding cook-off of a round or thermal ignition.

SUMMARY OF THE INVENTION

The present invention provides an instantaneous next round selection capability. The objective is achieved without major reconstruction of the gun, which is of the type described in Ser. Nos. 046,664 and 046,665 previously referenced.

In substance, the improvement involves continuously driving the feed sprockets at a nonuniform velocity and handing-off the selected round to the pocket of the feed rotor immediately before the feed rotor, which is intermittantly driven, presents the selected round to the bolt face. To achieve this type of hand-off, the gear train between the drive gear and the gear driving the selected one of the in-feed sprockets includes an additional gear transmission to drive the in-feed sprockets at a nonuniform angular velocity.

The functional effect of the present invention is the continuous advancement of a series of rounds through the feed mechanism by continuously advancing the round with the continuously rotating in-feed sprockets. By accelerating the motion of the sprockets immediately before the rotor indexes for the next round, the round is placed in the rotor pocket and at the last possible moment then presented to the bolt face.

The apparatus of the present invention includes a gear transmission in an externally driven gun which is driven by a source of external power which gun also has an ammunition feeder. The ammunition feeder includes at least one sprocket for feeding ammunition into a firing mechanism included within the gun. The gear transmission comprises an input means for providing a driving torque for the sprocket. The input means is coupled to the source of external power. An accelerating means is coupled to the input means and converts the substantially uniform rotation provided by the input means into an oscillating angular velocity. An output means is coupled to the accelerating means and couples the oscillating angular velocity to the sprocket for feeding the ammunition into the firing mechanism of the gun.

By means of this type of gear transmission in an externally driven gun, ammunition can be fed into the firing mechanism at a nonlinear rate such that phases of the ammunition sprocket can be selectively provided with relative periods of acceleration and deceleration. Furthermore, the handing-off of ammunition can be postponed until the last moment to allow the type of ammunition to be changed without having a round of a previously selected type of ammunition already committed to the firing mechanism.

In addition, by means of this gear transmission, the ammunition feed cycle can be stopped at a different point during the timing sequence such that the bolt, contained within the firing mechanism of a gun, is stopped at a relatively different position with respect to the barrel of the gun than can be achieved with a uniformaly driven ammunition feed sprocket. This allows an undetonated round of ammunition to be withdrawn from the hot barrel and substantially eliminates any possibility of cook-off of the unignited round.

In one embodiment of the invention, the gear transmission comprises an input shaft having an axis of rotation driven at a substantially uniform angular velocity by the external source of power. A planet gear is rotatably coupled to the input shaft at an axis offset from the axis of rotation of the input shaft. A stationary ring gear engages the planet gear and has an axis of symmetry congruent with the axis of rotation of the input shaft. A slider is rotatably coupled to the planet gear about an axis offset from the axis of rotation of the planet gear and from the axis of rotation of the input shaft. An output shaft, having an axis of rotation congruent with the axis of rotation of the input shaft is provided with a radial slot in which the slider is disposed and freely movable. The non circular motion of the slider, which results by being driven by the input shaft, is thus converted into an oscillating rotation of the output shaft.

In another embodiment a cam follower is rotatably coupled to the input shaft about an axis offset from the axis of rotation of the input shaft. The cam follower is guided in a cam race of a stationary cam. The cam race is a generally noncircular, closed path in which the cam follower is constrained to move. By rotation of the cam follower, generally about the axis of rotation of the input shaft, the cam follower is caused to rotate about its offset axis of coupling to the input shaft. A radial slot in the cam follower, which is radially defined with respect to the offset axis of coupling of the cam follower to the input shaft, provides a constraining slot for a member which is coupled to the output shaft. The member is disposed in the slot, is freely slidable therein and is coupled to the output shaft about an axis offset from the axis of rotation of the output shaft. The non circular motion of the slot, as the cam follower is rotated within the cam by the input shaft, is converted into an oscillating rotation in the output shaft.

The method of the present invention includes an improvement for feedng ammunition into an externally driven gun which has an ammunition feed sprocket and which is characterized by having a handing-off phase of operation. The improvement comprises the step of acceleratng the feed sprocket during the phase of handing-off and decelerating the feed sprocket during other phases of operation.

The method also comprises delaying the handing-off of ammunition into the firing mechanism of a gun as long as possible to delay the commitment of a type of round of ammunition to the firing mechanims of the gun. This delay permits the operator to select a different type of ammunition without having the previously used and now nonselected type of ammunition already committed to the firing mechanism of the gun.

The improvement of the method also includes stopping the gun operation prior to handing-off ammunition at a time such that the firing mechanism has already begun to be configured to accept a new round of ammunition by removing the old round of ammunition from the barrel of the gun. This substantially eliminates cook-off of unignited rounds of ammunition when the gun has stopped for changing ammunition type or any other reason.

Each of the above improvements is accomplished by a method comprised of the steps of coupling rotational motion from an external power source to an input shaft which has substantially uniform rotary motion and converting the substantially uniform rotary motion of the input shaft into an oscillating angular velocity. The oscillating angular velocity is then coupled to the ammunition feeder of the gun through an output shaft. Timing of the firing mechanism and bolt position within the firing mechanism is directly related to the phase of operation of the ammunition feed mechanism such that the oscillating angular velocity of the output shaft coupled to the ammunition feeder permits the above described advantageous relationship between commitment of an ammunition round and the configuration of the firing mechanism.

The improved method of handing-off ammunition in the gun can be practiced as follows. A planet gear is revolved about the axis of rotation of the input shaft. The planet gear is rotatably coupled to the input shaft about an axis offset from the axis of rotation of the input shaft. The planet gear is then rotated about its own axis of symmetry by means of engagement with a stationary ring gear. A stationary ring gear is circular and has its axis of symmetry congruent with the axis of symmetry of the input shaft. A cycloidal motion is produced in a slider about an axis offset from the axis of rotation of the planet gear by virtue of the rotatable coupling of the slider to the revolving and rotating planet gear. The cycloidal motion of the slider is then converted into an oscillating angular velocity by disposing the slider in a radially defined slot in the output shaft, the slot being radially defined with respect to the axis of rotation of the output shaft. The slider is freely movable in the slot. The output shaft then produces an oscillating angular velocity.

In another embodiment a cam follower is rotated about the axis of rotation of the input shaft. The cam follower is rotatably coupled to the input shaft about an axis offset from the axis rotation of the input shaft. The cam follower is rotated about this offset axis as it is rotated by the input shaft by virtue of the sliding engagement of the cam follower in a cam race provided by a stationary cam. The cam race is a generally noncircular, closed path. A slot radially defined in the cam follower with respect to the offset axis of coupling between the cam follower and input shaft is "cycloidally" rotated about the axis of rotation of the input shaft. A member coupled to the output shaft about an axis offset from the axis of rotation of the output shaft is disposed in the radial slot. The "cycloidal" motion of the slot is converted into oscillating motion of the output shaft by reason disposition of the member in the slot.

The invention can be better understood by considering the detailed description of the preferred embodiment in light of the drawings which are described below, wherein like elements are numbered with like reference numerals.

BRIEF DESCRIPTION OF THE DRAWINGS

FIG. 8*a* is a diagrammatic view of FIG. 8 showing the path of the center of a radially defined, driving slot in the cam follower.

FIG. 10*a* is a diagrammatic view of FIG. 10 showing the path of a driving, offset pin on the planet gear.

DETAILED DESCRIPTION OF THE PREFERRED EMBODIMENTS

Figure 1:
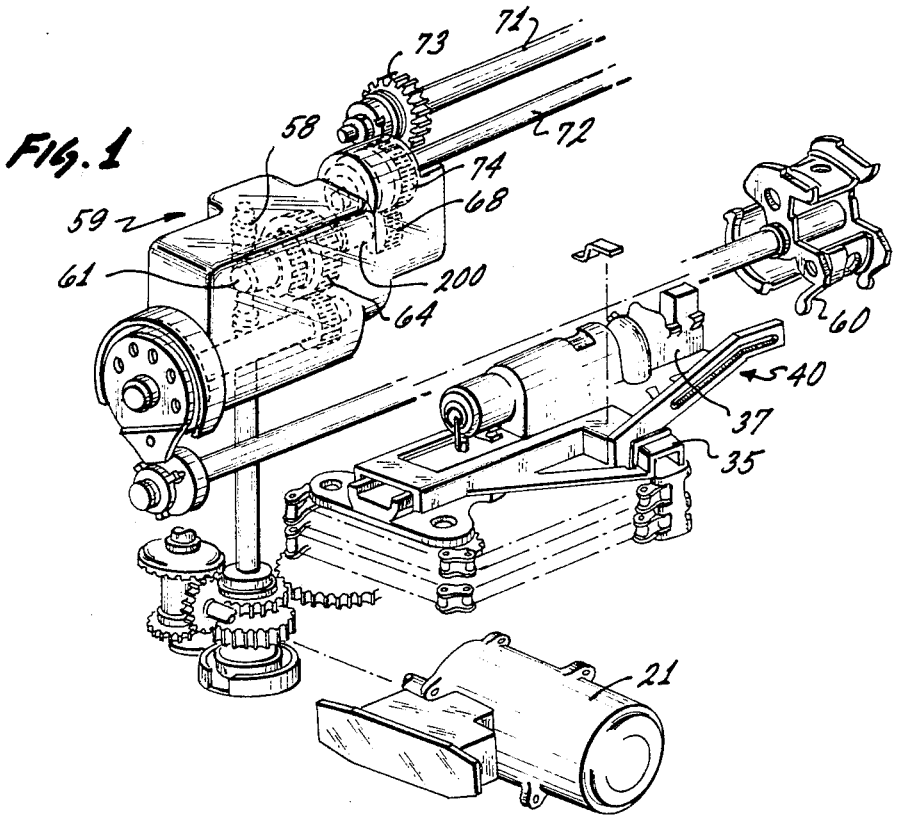
FIG. 1 is a perspective view of portions of the external drive and timing mechanism of a gun showing the incorporation of the improvement of the present invention within the gun and its coupling to the chain driven bolt mechanism, infeed sprocket, and feed rotor.

The present invention is a gear transmission in an externally driven gun which permits change of ammunition type in a gun having a dual type ammunition feeder such that first round selectivity is obtained, and such that "cook-off" is avoided.

First round selectivity is obtained by delaying the transfer of a round from the in-feed sprocket to the feed rotor until the last possible moment, and then accelerating the handing-off of the round from the in-feed sprocket to the feed rotor.

"Cook-off" of an unignited round in a hot barrel, is the thermal ignition of a round. This is avoided during a normal stop of the operation of the gun, a stop typically to change ammunition type fed into the ammunition feeder, by stopping the bolt after it has retracted the unignited round from the barrel to such a degree that no substantial thermal contact remains between the barrel and the unignited round.

More specifically, when changing from one type of ammunition to another, firing is stopped. In accordance with this invention, the bolt is stopped by a sear link engaging a sear located near the path of the chain to which the sear link is coupled such that the bolt is in rearward movement and cleared from thermal contact with the breech. Assuming that the race track-like path of the chain represents 360 degrees of travel, the sear is positioned to stop the bolt after about 320 degrees of chain travel.

For each 90 degrees of rotation of the in-feed sprockets, one round is handed-off to the pocket of the feed rotor. By the time the sear link reaches the sear position, the in-feed sprocket has rotated approximately 63 degrees of the 90 degrees or two thirds of the cycle needed to hand-off the round. At this point the chain has only 11% of its cycle left to travel the needed distance before the feed sprocket feeds the next round to the rotor. The in-feed sprocket, however, must rotate 27 degrees more or 30% of its cycle to hand-off the round. Accordingly, to make up difference in in-feed sprocket travel needed as compared to chain travel, the added gear transmission accelerates rotation of the in-feed sprockets through the last 27 degrees to end the in-feed cycle just as the rotor movement begins. The master link moves the last 40 degrees of travel, from its sear position to the rear and rested position of the bolt, while the in-feed sprockets are accelerated, the round is handed-off to the feed rotor, and the in-feed sprocket is then decelerated.

In addition to providing next round selection, the present invention greatly simplifies down-loading of this type of gun. More specifically, since there is no live round in the feed rotor when firing is normally stopped, it is a comparatively simple matter to turn the in-feed sprocket of the declutched in-feed assembly backwards to remove the unfired rounds. The gunner will be assured by the present invention that all rounds are then removed from the gun. In the prior guns, it was also necessary to remove the feeder to separately remove the one remaining round in the pocket of the feed rotor.

The means by which this can be accomplished and other objects of the invention can be better understood by viewing FIG. 1. FIGS. 1–6 are based upon the gun previously disclosed and applications previously filed on behalf of the assignee of the present application, namely Leonard Price, entitled "Single Barrel Externally Powered Gun" filed on Apr. 21, 1977, Ser. No. 789,502; Bohorquez et al., entitled "mechanical Anti-Hangfire System" filed on June 8, 1979, Ser. No. 046,664; and Sallach et al., entitled "Compact Clutch Mechanism" filed on June 8, 1979, Ser. No. 046,665. For the convenience of the reader, the reference numerals as appear in FIGS. 1–6 in the present application are the same as appearing in corresponding FIGS. 2–7 of the U.S. application Ser. No. 789,502 just cited. Elements which are added or modified according to the present improvement are denoted by a reference character having a number equal to 200 and above. Therefore, the operation of the gun as disclosed by the above applications will not be repeated here except to clarify the relation of the present improvement to the previously disclosed aspects of the gun and to clarify the structure and function of the present improvements. Wherever, a previous disclosure is referenced, it is meant to indicate one of these prior applications.

The environment in which the improvement of the present invention is used can be best understood by viewing FIG. 1. A gear transmission 200 as described below is retrofitted into the previously disclosed gun between drive gears 64 and 68 included within gear train 59. The shaft between gears 64 and 68 is, in essence, broken and transmission 200 coupled therebetween. Transmission 200 converts the substantially uniform rotation imparted to transfer shaft 61 by worm gear 58 ultimately driven by motor 21, into an oscillating rotation coupled through drive gear 68 to constant mesh gears 73 and 74 to selectively drive either shaft 71 or 72 but not both. Drive shafts 71 and 72, are coupled to in-feed sprockets 17 and 18 as best as shown in FIG. 2.

Figure 2:
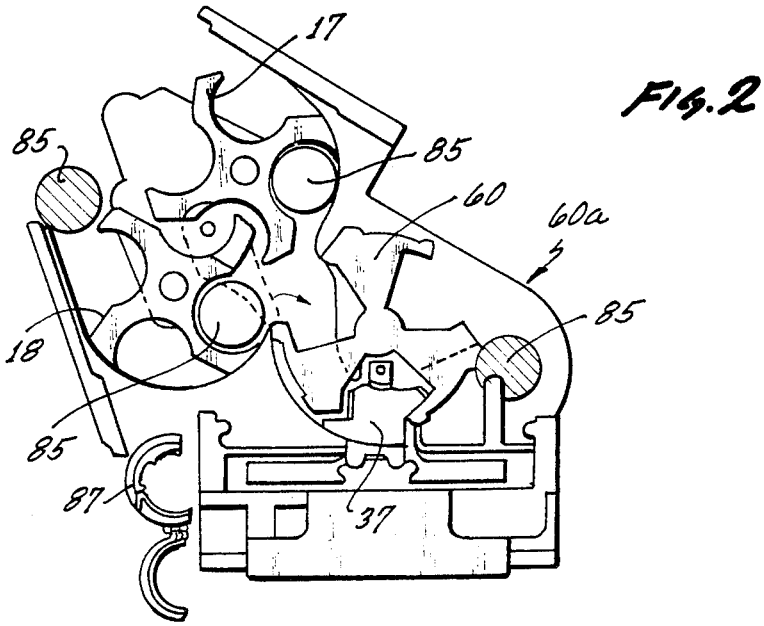
FIG. 2 is a cross section taken through the ammunition feeder of a gun showing the relationship between two ammunition infeed sprockets and the feed rotor.

In-feed sprockets 17 and 18 strip ammunition 85 from a link belt 87 and hand-off ammunition 85 to a feed rotor 60 shown in both FIGS. 1 and 2. FIG. 2 illustrates ammunition 85 being engaged both by in-feed sprockets 18 and 17. In-feed sprockets 17 and 18 provide to feed rotor 60 two different types of ammunition, such as rounds varying in ballistic flight properties or projectile characteristics. Feed rotor 60 has three open areas or pockets defined between the three lands for receiving ammunition 85 as it is handed-off by in-feed sprockets 17 or 18. Feed rotor 60 then carries the round of ammunition of the selected type by an intermittent rotation, as previously disclosed, into the bolt of the gun for ramming and firing by the reciprocating bolt action of the gun. The three lands forming feed rotor 60 are appropriately notched to provide clearance for a bolt mechanism 37 and to provide suitable contact surfaces for the ejection of ammunition 85. Both in-feed sprockets 17 and 18 and feed rotor 60 are comprised of two such identical sprockets or rotors coupled along a central shaft to provide parallel and secure engagement with the fore and aft portions of each round of ammunition 85. The double rotor configuration for feed rotor 60 is best illustrated in FIG. 1.

After round 85 is fired, it is moved by feed rotor 60 to the eject position shown in FIG. 2, generally denoted by the reference character 60*a*. An ejector arm 40, illustrated in FIG. 3, contacts the spent shell casing of ammunition round 85 and ejects the round through ejection tube 82 when bolt carrier 35 moves forward in the subsequent ramming phase.

In the gun, as previously disclosed, in-feed sprockets 17 and 18 were driven at a substantially uniform angular velocity to feed ammunition 85 into feed rotor 60. Any variation in the angular velocity of either in-feed sprockets 17 or 18 was reflected throughout the gun's operation generally and ultimately reflected in the output RPM of motor 21. Thus, for the purpose of this specification, "substantially uniform angular velocity" is meant to be defined with respect to the general timing of the gun or the output RPM of motor 21. It is to be understood that the gun can be driven at various speeds and each of its parts thus reflect a coresponding angular velocity, speed or cyclic frequency. It is entirely within the scope of the present invention that the speed at which the gun is driven may be varied during operation according to factors not relevant here. Therefore, the speed at which the gun is driven by motor 21 or any other such external power source shall be defined as substantially uniform, and usually is in fact generally uniform during any one cycle of operation. Acceleration or deceleration of in-feed sprockets 17 and 18 according to the present invention are thus made relative to the average velocity of the sprockets during a single cycle. The average velocity between cycles may vary arbitrarily in so far as the operation of the present invention is concerned.

The details of gear transmission 200, diagrammatically shown in FIG. 1, will be described below after the output/input characteristics of transmission 200 are specified and the significance of that output characteristic explained.

Figure 10:
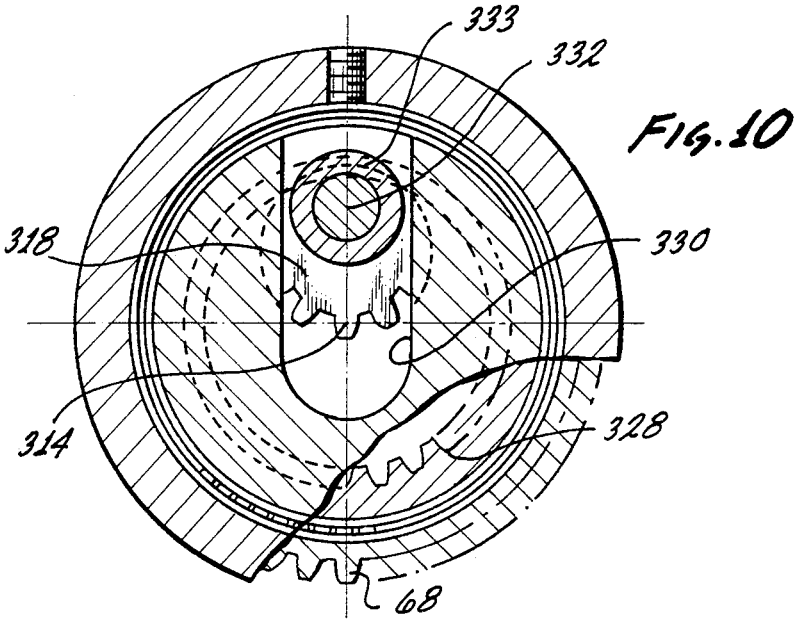
FIG. 10 is an end view of the embodiment shown in FIG. 9.
Figure 11:
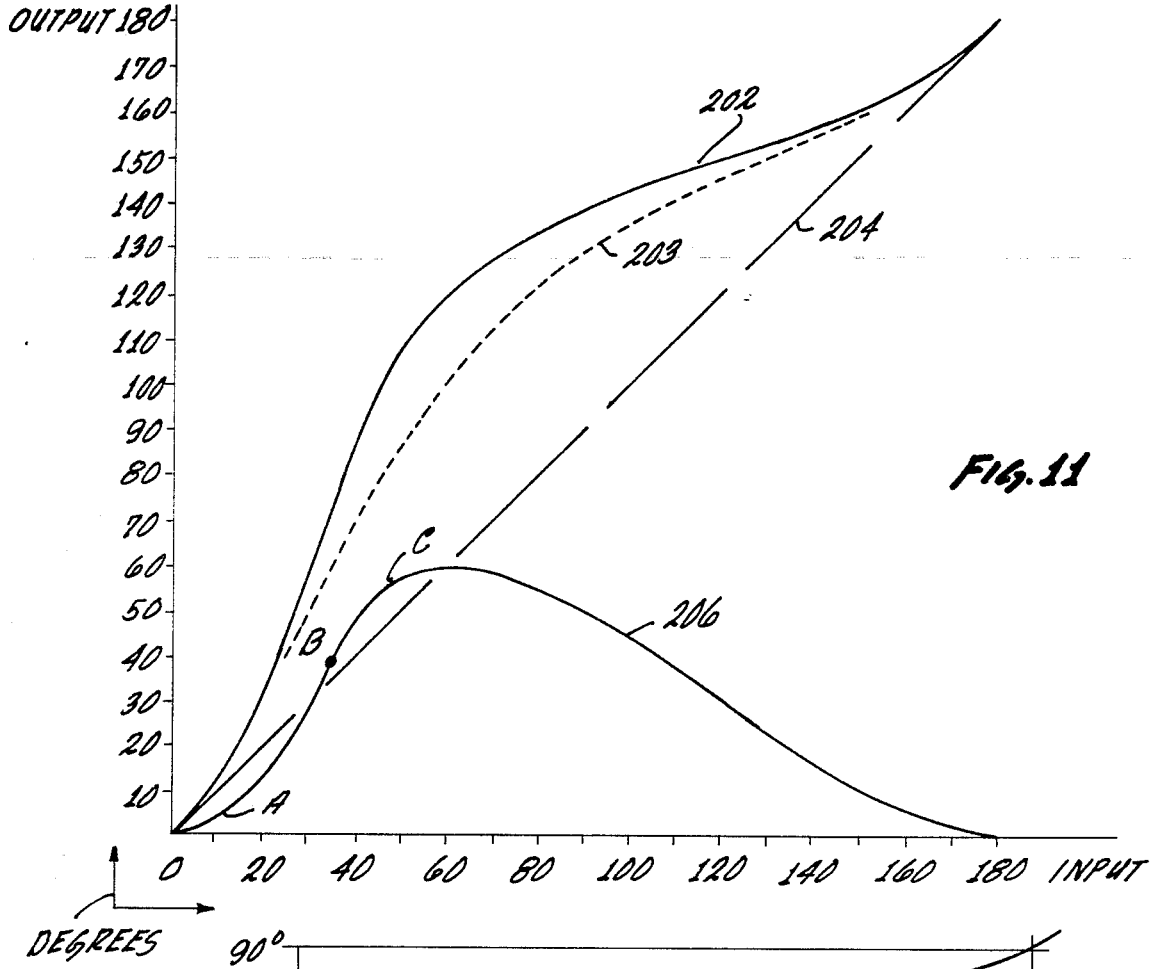
FIG. 11 is a graph illustrating the acceleration and deceleration provided by the gear transmission.

FIG. 11 shows the input/output relationship of transmission 200. The horizontal axis represents the angular displacement of the input shaft of transmission 200. Gear transmission 200 completes two cycles for every rotation of the input shaft. The vertical axis represents the angular displacement of the output shaft coupled to transmission 200. Curve 202 defines the input and output relationship between the input and output shafts of transmission 200 of FIGS. 9 and 10, and curve 203 represents the input/output relation of the embodiment of FIGS. 7 and 8. Straight line 204, shown as having a 45 degree slope, represents a direct gear drive between the input and output. The rate of change of the displacement of curves 202 and 203 from the direct drive relationship described by line 204 illustrates the amount of acceleration and deceleration provided by transmission 200 as compared to the direct drive relationship exhibited by transfer shaft 61 of the previously disclosed gun.

The difference between curve 202 and line 204 is more directly illustrated by curve 206 of the graph of FIG. 11 which shows the difference in angular displacement between the output shaft from transmission 200 and its input shaft. Curve 206 illustrates that transmission 200 provides a sharp output acceleration between points A and C, which acceleration slows until reaching the maximum at approximately 60 degree angular displacement of the input shaft and thereafter begins to decelerate until the input shaft has rotated 180 degrees at which time the total angular displacement between the input and output shaft is zero, both shafts having then rotated 180 degrees. Thus transmission 200 provides a sharp acceleration during approximately one third of its cycle. This is the portion of the in-feed cycle of sprockets 17 or 18 during which ammunition 85 is being handed-off.

Figure 12:
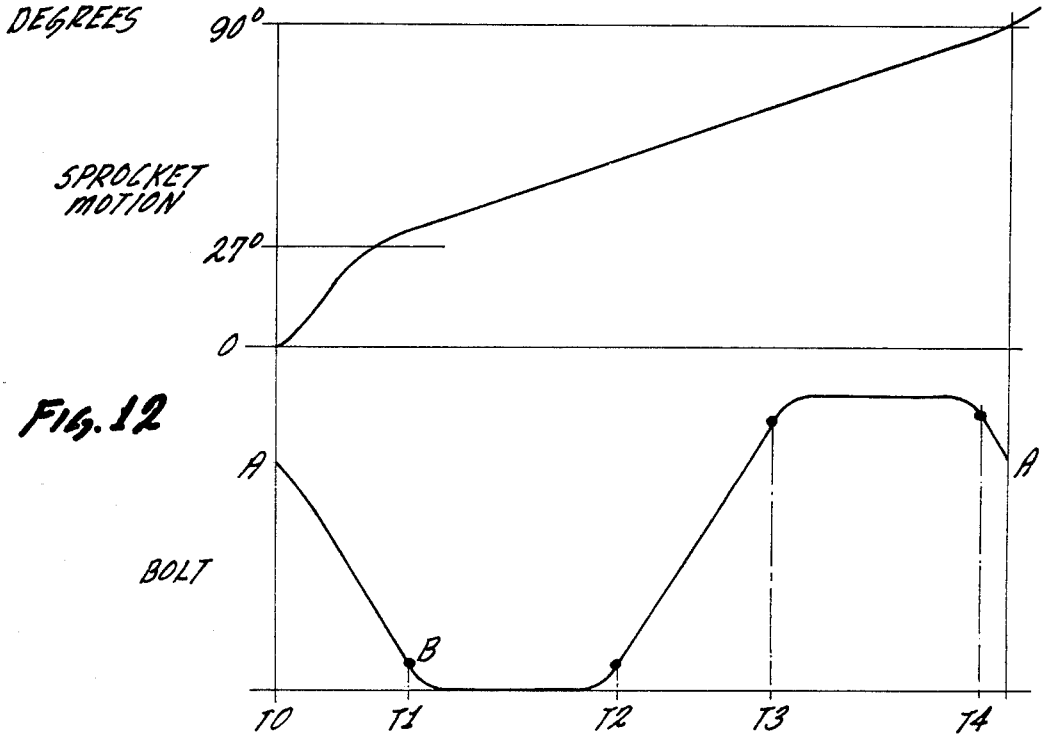
FIG. 12 is a graph illustrating the relationship between ammunition in-feed sprocket position and bolt position according to the present invention.

FIG. 12 illustrates the sprocket motion executed by in-feed sprockets 17 or 18 in response to the output of gear transmission 200 as illustrated in FIG. 11. The combination of drive gear 68 and constant mesh gears 73 and 74 provide a gear reduction such that in-feed sprockets 17 or 18 rotate through 90 degrees when drive gear 68 rotates through 180 degrees.

The upper portion of FIG. 12 shows the angular displacement of either in-feed sprockets 17 or 18 as measured against time. During the initial interval between T0 to T1, in-feed sprockets 17 or 18 are displaced through approximately 27 degrees. After T1 the angular displacement of in-feed sprockets 17 or 18 slows appreciably until the sprocket has rotated 90 degrees at which time the cycle repeats.

Meanwhile, as shown in the lower portion of FIG. 12, the reciprocating bolt within the gun firing mechanism moves from an almost fully closed position at position A and time T0 to an almost fully open position B at time T1. Thus, round 85 is handed off from in-feed sprockets 17 or 18 to feed rotor 60 during time T0 to T1. The bolt remains to the rear between T1 and T2 as feed rotor 60 feeds the handed-off round into the bolt mechanism after which time the bolt rams the round into the barrel by time T3. Between time T3 and T4, the round is fired and the cycle repeated with the spent round being partially withdrawn between T4 of one cycle and T0 of the subsequent cycle.

Comparison of the upper and lower portions of FIG. 12 illustrate that in-feed sprockets 17 or 18 rotate at a reasonably slow angular velocity between times T1 and T0. Since the new round is handed off by in-feed sprockets 17 or 18 between times T0 and T1 and rotated into the bolt mechanism between T1 and T2, feed rotor 60 is empty and remains empty insofar as the next round is concerned until T1 of the subsequent cycle. During this time, in-feed sprockets 17 or 18 continue to rotate, but at a slower angular velocity. A subsequent round in not handed-off until just before the bolt mechanism reaches position T1. The round is in the firing mechanism, which includes feed rotor 60, only between T0 and T2. At all other times, feed rotor 60 has neither received a new round nor is delivering a round to the bolt.

Thus, the gun can be stopped as late as T0 of the subsequent cycle without having committed a round of ammunition to feed rotor 60. As illustrated in the bottom portion of FIG. 12, the bolt mechanism has begun to open and is partially opened at position A. Positive engagement of the bolt with the round withdraws the round from the barrel. Withdrawal of the round is sufficient such that the round is not in substantial thermal contact with the barrel at position A. If the round has not been ignated, there will be insufficient contact between the barrel and the round to cause thermal ignition if percussion ignition has failed.

Figure 3:
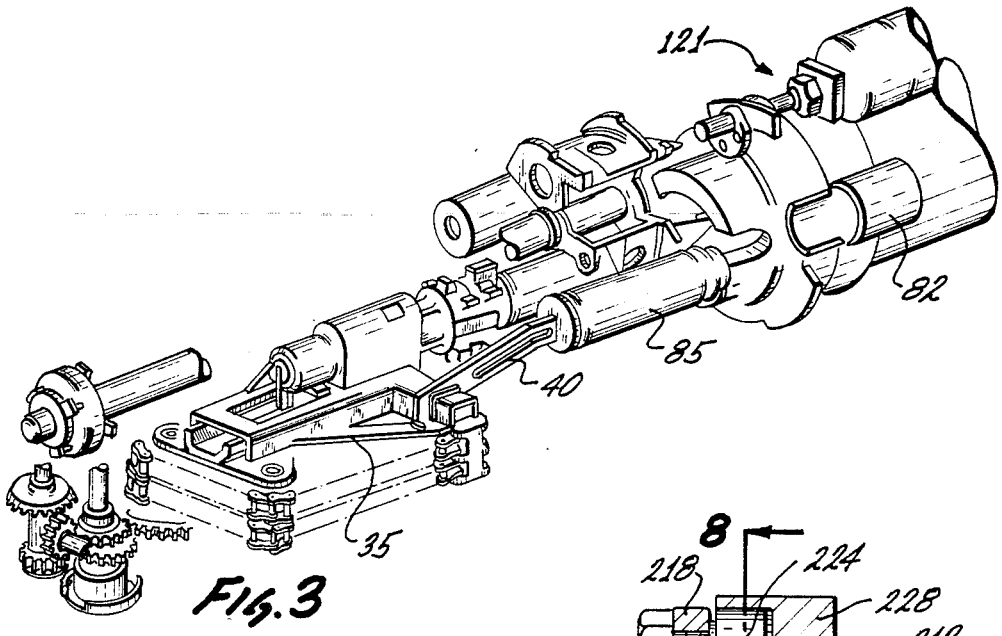
FIG. 3 is a perspective of a portion of the gun showing the relation of the chain driven bolt mechanism to the feed rotor and barrel of the gun.
Figure 7:
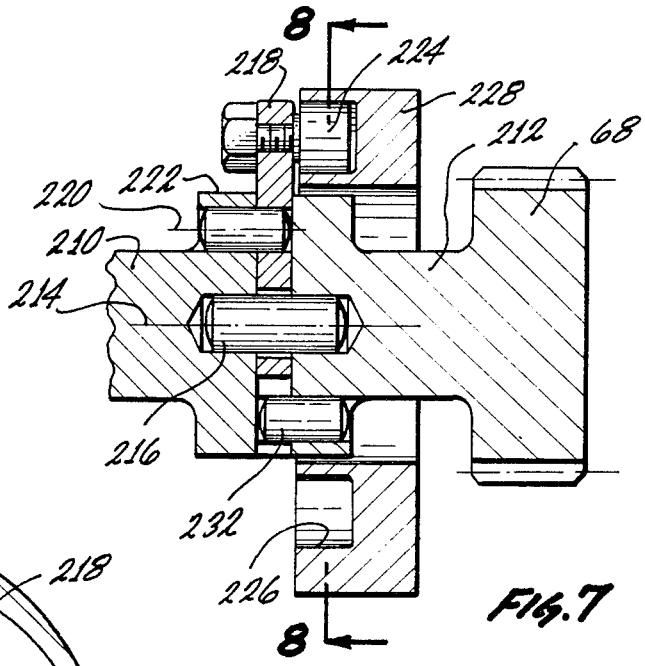
FIG. 7 is a cross section of the embodiment of the gear transmission which employs a cam follower and stationary cam.
Figure 8:
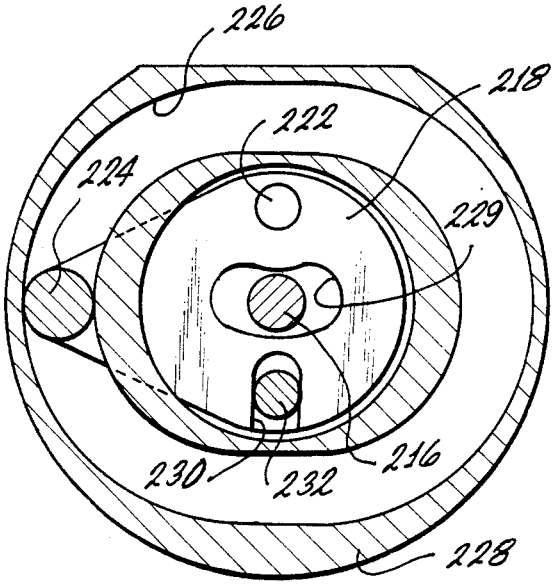
FIG. 8 is an end plan view of the embodiment shown in FIG. 7 illustrating the relationship and shape of the cam follower, cam, various offset axes relating to the cam follower, and the input and output shafts.
Figure 9:
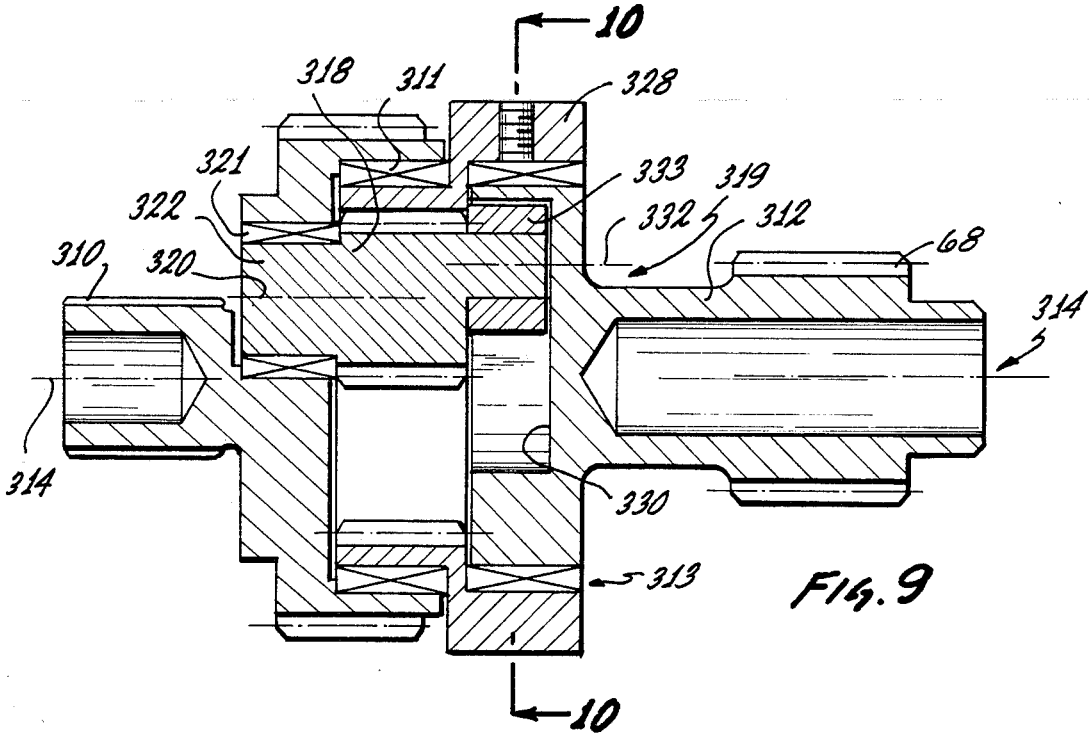
FIG. 9 is a partially cut away side view of the gear transmission of the embodiment which utilizes a planet and ring gear to provide oscillating rotation.

A gear transmission 200 capable of performing as illustrated in FIGS. 11 and 12 and in the environment illustrated in FIGS. 1–3, is shown in two embodiments, one embodiment in FIGS. 7 and 8 and an alternative embodiment in FIGS. 9 and 10. The retiming of the firing mechanism of the gun is diagrammatically illustrated in FIGS. 4–6.

Figures 4, 5, 6:
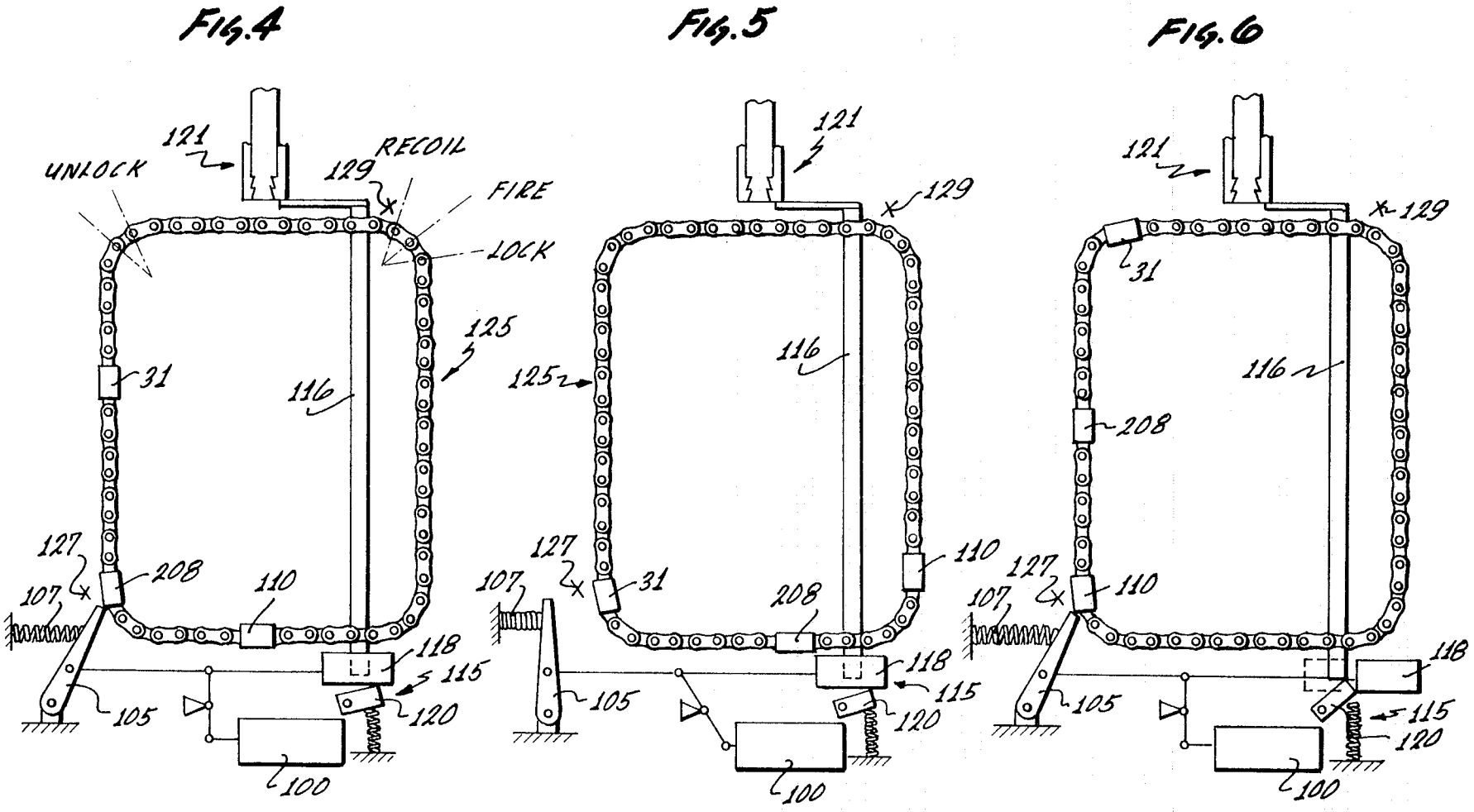
FIGS. 4–6 are schematic plan views of the drive chain of the gun illustrating the functional operation of the sear and master links of the gun and their relation to the ammunition feed and bolt position.

First, consider the retiming of the gun as illustrated in FIG. 4. The various elements, master link 31, safety link 110, sear 105, sear spring 107, sear solenoid 100 and the remaining elements are the same as previously disclosed except that a sear link 208 is added to chain 125 between master link 31 and safety link 110. In addition, master link 31 is modified such that it no longer is engageable with sear 105. Therefore, only sear link 208 and safety link 110 are capable of coacting with sear 105 to stop the operation of the gun. Master link 31 is still coupled to bolt carrier 35 and operates in essentially the same manner as previously disclosed.

In the preferred embodiment, chain 125 is 46 links long. Safety link 110 and master link 31 are separated by 11 links. Sear link 208 is positioned between safety link 110 and master link 31 such that six chain links separate sear link 208 from safety link 110 and five chain links separate sear link 208 from master link 31. The timing of chain 125 as illustrated in FIGS. 4–6 can now be reviewed with the inclusion of the improvement of the present invention.

As shown in FIG. 4, the gun is in the normal, open bolt, shutdown mode. However, the bolt is not entirely open as was previously the case. Instead, the gun has shutdown and been stopped when sear 105 comes into contact with sear link 208. Sear solenoid 100 is de-energized and sear 105 is biased by a compression spring 107 against sear link 208 at a position in travel just forward of the center line of the drive sprocket. The lock, fire, recoil and unlocked positions of the master link are unchanged and are indicated in FIG. 4. Forward of sear link 208 with respect to the direction of chain movement is safety link 110. Latch 115 is shown in FIG. 4 in the unlatched position in combination with recoil push rod 116 which is in the static, nonrecoil position. Safety link 110, push rod 116 and recoil latch 115 coact with solenoid 100 and sear 105 in the exact manner as previously disclosed and will not be redescribed here. Safety link 110 serves to stop the action of the gun as shown in FIG. 6 upon failure of a recoil in order to provide hangfire protection as before. As previously disclosed, hangfire protection maintains the bolt in a locked position for a sufficient period of time to allow a slowly ignition round to fire. By including sear link 208 at the position between master link 31 and safety link 110, cook-off protection is also added.

In FIG. 5, gun action has just started. Solenoid 100 is energized and sear 105 is disengaged permitting the chain to move. Recoil latch 115 is about to be set by movement of recoil latch foot 118.

If the chambered round fires properly, recoil of the barrel and breech 121 moves recoil latch 120 through push rod 116, releasing foot 118 so that sear 105 is retracted by solenoid 100, which is still energized at the state indicated in FIG. 5. If there is no hangfire, safety link 110 continues past position 127 and master link 31 continues past position 129. The gun operator is then provided with the option of stopping the gun at the position determined by sear link 208. Inasmuch as the gun has properly fired, solenoid 100 is energized, sear 105 moved out of position and the chain will not stop unless the operator deenergizes solenoid 100 by releasing the trigger, thereby stopping the chain in the position illustrated in FIG. 4. As illustrated and discussed in connection with FIG. 12, sear link 208 is positioned on the chain such that the gun will be stopped by sear link 208 at time T0 when the bolt is at position A, namely in a partially retracted position.

Gear transmission 200, which produces the oscillating rotation of FIG. 11, can now be described and understood in connection with FIGS. 7–10. The first embodiment is illustrated in FIGS. 7 and 8 wherein a cam follower and cam combination is utilized. Transfer shaft 61 is extended from gear 64 to form an input shaft 210, and is extended from drive gear 68 to form an output shaft 212. Input shaft 210 is characterized by having an axis of rotation 214 which is congruent with the axis rotation of output shaft 212 as illustrated in FIG. 7. The congruence of the two separate shafts is ensured by means of an alignment pin 216. A cam follower 218 is rotatably coupled to input shaft 210 about an offset axis 220 which is parallel to axis rotation 214. Cam follower 218 is rotatably coupled to input shaft 210 by means of an alignment pin 222. Cam follower 218 is also provided with a roller 224 mounted upon an eccentric extension of cam follower 218. Roller 224 rolls or slides inside a cam race 226 defined in a stationary cam 228. The shape of cam follower 218 and the engagement of roller 224 with cam race 226 are best illustrated in FIG. 8.

Cam follower 218 is provided with an appropriate shaped opening 229 to allow for clearance of alignment pin 216. In addition, cam follower 218 has a radially defined slot 230 defined in a side of cam follower 218 oppositely disposed from pin 222 about which cam follower 218 rotates. Slot 230 is radially defined with respect to the center of pin 222. Output shaft 212 has a member or pin 232 coupled thereto and extending into slot 230. The coupling of pin 232 to output shaft 212 is best shown in FIG. 7, and the coupling of pin 232 to slot 230 is best shown in FIG. 8. Pin 232 defines an axis which is offset from and parallel to axis of rotation 214.

As shown in FIG. 8 roller 224 of cam follower 218 travels in cam race 226 as input shaft 210 rotates. The path described by a fixed point within slot 230 is generally non-circular as determined by the shape of cam race 226. The actual path is shown diagrammatically in FIG. 8*a* as similar to a flattened cycloidal path 227. In the embodiment illustrated in FIG. 8, cam race 226 is a generally non-circular, closed path. In particular, in the preferred embodiment, cam race 226 is comprised of two circular end sections coupled by a straight section thereby forming an elongated circle. It is entirely possible that cam race 226 may be provided with many other shapes such as elipses or arbitrarily defined shapes as determined by the acceleration and deceleration specifications of the type illustrated in FIG. 11. The circular end sections joined by the straight sections as illustrated in FIG. 8 results in the look-like-flattened-cycloidal performance of the embodiment of FIGS. 7 and 8 as shown in FIG. 11 by curve 203.

Another embodiment is illustrated in FIGS. 9 and 10. An input shaft 310 has rotatably disposed therein a planet gear 318. Planet gear 318 is rotatably disposed about an axis 320 defined by shaft 322 in input shaft 310. Axis of rotation 320 is offset from and parallel to the axis of rotation 314 of input shaft 310. Roller bearings 321 are provided between shaft 322 and input shaft 310 in order to increase the ruggedness and efficiency of gear transmission 200. Planet gear 318 is rotatably engaged to a stationary ring gear 328. A shaft 332 extends from planet gear 318 and defines an axis 319 which is offset from and parallel to axis 320 of planet gear 318 and from axis 314 of input shaft 310. Shaft 332 is provided with a slider 333, best seen in FIG. 10, to slidably engage a radially defined slot 330. Slot 330 is radially defined with respect to the axis of rotation 314 of output shaft 312. The axis of rotation 314 of output shaft 312 and input shaft 310 are aligned or congruent. Output shaft 312 is aligned with input shaft 310 by means of needle bearings 313 provided between output shaft 312 and stationary ring gear 328. Similarly, input shaft 310 is journalled with respect to stationary ring gear 328 by needle bearings 311.

As best shown in FIG. 10*a*, shaft 332 traces a "cycloidal" path 329 inside ring gear 328. Planet gear 318 revolves about axis of rotation 314 as input shaft 310 turns. By engagement with the gearing of ring gear 328, planet gear 318 then rotates about its own axis of rotation 320 during the revolution. Planet gear 318 makes one rotation about axis 320 for each half revolution about axis 314. During this time, shaft 332 will trace out one complete, "cycloidal" cycle. Slider 333 within slot 330 converts the azimuthal component of the cycloidal motion into the oscillating rotation in output shaft 312. Curve 202 describes the output performance of output shaft 312. The radial component of the cycloidal motion of shaft 332 is taken up by free sliding movement of slider 333 within slot 330.

The embodiment of gear transmission 200 shown in FIGS. 9 and 10 does not have the design flexibility of the embodiment of gear transmission 200 shown in FIGS. 7 and 8. Gear transmission 200 of FIGS. 9 and 10 is clearly limited to producing one type of the purely cycloidal forms of motion, while the embodiment of gear transmission 200 in FIGS. 7 and 8 is capable of not only generating the same family of cycloidal output curves, but can generate nearly an arbitrary number of other families of curves according to the shape of cam follower 218 and cam race 226. In a retrofit application the only limitation upon the embodiment of FIGS. 7 and 8 is the overall size restrictions which are imposed upon gear transmission 200 to ensure that the transmission fits within the outlines of a gear box designed for the previously disclosed gun.

Thus, it should be clear that many other modification alterations may be made by those having ordinary skill in the art without departing from the spirit and scope of the present invention. For example, not only may varying cam and cam race combinations be made in the embodiment of FIGS. 7 and 8, but other gearing ratios within the embodiment of FIGS. 9 and 10 can be employed to produce different kinds of cycloidal motion than that illustrated by path 334. The pin and slot combination in both embodiments may be reversed, i.e. the pin may be fixed to the cam follower and the slot defined in the output shaft. To this end, the number of fingers of in-feed sprockets 17 and 18 or feed rotor 60 can similarly be altered along with corresponding changes in the gun timing to accommodate such changes. The present invention can similarly be advantageously used in guns employing only a single type of ammunition where an accelerated "kick" of the round into the firing mechanism would be advantageous. The invention can also be advantageously employed in multiple barrel guns. The foregoing has been described merely as illustrative and preferred embodiments of the invention and are not to be taken as limitations or restrictions of its scope as set forth in the following claims.

We claim:

1. In an externally driven gun in combination with a source of external power for driving said gun including an ammunition feeder and firing mechanism, said feeder including at least one sprocket for feeding ammunition into said firing mechanism within said gun, a gear transmission comprising;

input means for providing a driving torque for said sprocket, said input means being coupled to said source;

accelerating means for converting substantially uniform angular velocity into oscillatory angular velocity and output means coupled to said accelerating means for coupling said oscillatory angular velocity from said accelerating means to said sprocket for delayed feeding of ammunition into said firing mechanism of said gun, said delayed feeding being timed relative to firing of said ammunition according to a predetermined relationship, said accelerating means being coupled to said output means, whereby an externally powered gun driven at a uniform speed feeds ammunition into said firing mechanism of said gun at a nonlinearly changing velocity wherein the velocity of said sprocket and ammunition fed thereby is selectively provided with periodic acceleration and deceleration in order to delay said handing-off until the last opportunity possible to do so.

2. The gear transmission of claim 1 wherein:

said input means includes an input shaft having a first axis of rotation driven at a substantially uniform angular velocity by said external source;

said accelerating means includes a planet gear rotatively coupled to said input shaft at a second axis offset from said axis of rotation of said input shaft, a stationary ring gear engaging said planet gear, said ring gear having its axis of symmetry congruent with said first axis of rotation of said input shaft, and a slider rotatably coupled to said planet gear about a third axis offset from said second axis of rotation of said planet gear; and said output means includes an output shaft having an axis of rotation congruent with first axis of rotation of said input shaft and having a radial slot defined therein wherein said slider is disposed and freely movable in said slot, whereby substantially uniform angular velocity of said input shaft is translated by said planet gear and ring gear into a cycloidal motion of said slider, and movement of said slider within said slot converted into an occillatory rotation by said output shaft.

3. The gear transmission of claim 2 characterized by a central axis defined by said input and output shafts wherein said planet gear is rotatably coupled to said input shaft by a roller bearing disposed in said input shaft along an axis parallel to and offset from said central axis, said input shaft being rotatably disposed with respect to said stationary ring gear by a first needle bearing between said input shaft and said ring gear, and said output shaft rotatably coupled to said stationary ring gear a second needle bearing.

4. The gear transmission of claim 1 wherein:

said input means includes an input shaft having a first axis of rotation driven at a substantially uniform angular velocity by said external force;

said accelerating means includes a cam follower and cam wherein said cam follower is rotatively coupled to said input shaft at a second axis offset from said first axis of rotation of said input shaft, said cam follower being in movable contact with said cam along a generally noncircular, closed path such that said cam follower rotates about said second axis of coupling to said input shaft as said cam follower is displaced with respect to said stationary cam, said cam follower having a radial slot defined therein with respect to said second axis of rotation; and said output means includes an output shaft having a third axis of rotation congruent with said first axis of rotation of said input shaft and having a member slidably disposed within said radial slot within said cam follower and freely movable therein, said member being coupled to said output shaft about a fourth axis offset from said third axis of rotation of said output shafts, wherein substantially uniform angular velocity of said input shaft is translated by said cam follower and cam into a cycloidal motion of said slot, movement of said member within said radial slot being converted into an oscillatory angular velocity by said output shaft.

5. The gear transmission of claims 1, 2, 3 or 4 further comprising a chain driven bolt and a timing chain included in said firing mechanism of said gun, a sear and a master link coupled to said chain, a driving mechanism to open and close said bolt, wherein said master link is coupled to said driving mechanism, said sear link and said master link are positioned on said chain such that said chain is selectively stopped by stopping said sear link when said master link positions said bolt in a partially opened position, wherein ammunition coupled to said bolt is removed from effective thermal contact with a barrel of said gun, and wherein said sprocket driven by said gear transmission stops in a position prior to handing-off a new round of ammunition to said firing mechanism of said gun, whereby said gun can be loaded without danger of cook-off of a round previously loaded in said firing mechanism and without a new round being committed to said firing mechanism.

6. An improvement in a gun driven by a source of external power, and having a firing mechanism and an ammunition feeder, said feeder having a sprocket, said feeder for handing-off ammunition of at least two types to said firing mechanism within said gun, said improvement comprising:

means for stopping said sprocket prior to handing-off one of said types of ammunition to said firing mechanism; and means for accelerating said sprocket to quickly hand-off a selected type of ammunition to said firing mechanism after selection of said type has been made, activation of said means for accelerating being delayed in time until hand-off of said type of said ammunition to said firing mechanism is just possible in a given time period required for such accelerated hand-off, whereby commitment of a type of ammunition to be handed-off to said firing mechanism is postponed well beyond the time at which said firing mechanism begins to be configured to accept said ammunition and then handing-off is accelerated after selection is made.

7. The improvement of claim 6 wherein said means for accelerating said handing-off of ammunition comprises:

input means coupled to said source;

oscillating means coupled to said input means for converting uniform rotation of said input means into oscillatory angular velocity; and output means coupled to said oscillating means for coupling said oscillatory angular velocity to said rotor.

8. The improvement of claim 6 wherein said means for accelerating comprises:

an input shaft having a first axis of rotation coupled to said external source of power;

a cam follower rotatably coupled to said input shaft on a second axis offset from and parallel to said first axis of rotation of said input shaft;

a stationary cam slidably coupled to said cam follower and providing a generally noncircular, closed cam race for said cam follower such that said cam follower is rotated about said first axis of rotation and such that said cam follower rotates in slidable contact with said cam race, said cam follower having a slot radially defined therein with respect to said second axis of rotation;

an output shaft having a third axis of rotation congruent with said first axis of rotation of said input shaft; and a member slidably disposed in said radial slot of said cam follower and coupled to said output shaft about a fourth axis offset from and parallel to said third axis of rotation of said output shaft.

9. The improvement of claim 6 wherein said means for accelerating comprises:

an input shaft having a first axis of rotation coupled to said external source of power;

a planet gear rotatably coupled to said input shaft at a second axis offset from and parallel to said first axis of rotation of said input shaft;

a stationary ring gear engaging said planet gear and having an axis of symmetry congruent with said first axis of rotation of said input shaft;

a slider rotatably coupled to said planet gear about a second axis offset from and parallel to said second axis of rotation of said planet gear; and an output shaft having a radial slot defined therein for slidably engaging said slider, said output shaft having a fourth axis of rotation congruent with said first axis of rotation of said input shaft.

10. The improvement of claims 6, 7 or 8 including a timing chain coupled to said external power source, said timing chain having a master link and a sear link coupled thereto, said master link coupled to a bolt within said firing mechanism within said gun, wherein said improvement further comprises a displacement between said sear and master link such that when said gun stops firing and said sear link assumes a predetermined stopped position, said master link will be positioned such that said bolt is partially retracted from a barrel of said gun and said sprocket is stopped at a position just prior to handing-off a selected type of ammunition round to said firing mechanism of said gun.

11. An externally powered gun mechanism capable of a high rate of fire comprising:

a supporting receiver structure carrying at least one gun barrel in fixed stationary relation to the supporting receiver structure;

at least one driven bolt assembly movable in reciprocating motion towards and away from the associated gun barrel;

at least one drive chain drive assembly mounted on said supporting structure and continuously operating during a firing cycle to advance the cooperating bolt assembly through a cycle of feeding, ramming, firing, extracting, and ejecting;

a driven rotor assembly cooperating to feed rounds to said bolt assembly and for ejecting the spent casing;

a driven sprocket assembly cooperating to selectively hand-off one of at least two types of rounds to said feeder assembly; and means forming a power transmission system for driving said chain drive assembly and for driving said sprocket and rotor assembly in periodic oscillation in synchronism with said chain drive assembly to hand-off said rounds from said sprocket assembly to said rotor assembly at the last possible moment at which said round can be accepted by said rotor assembly;

wherein said chain drive assembly including means driven along a predetermined path of travel which includes portions defining the timing and sequence of the cycle of feeding, ramming, firing, extracting and ejecting;

means to support and to drive said chain through a predetermined path of movement, and said means driven along said predetermined path of travel being carried by said chain member to advance said bolt assembly towards and away from said barrel;

said means which are driven along said predetermined path being operative to effect reciprocation of said bolt assembly.

12. The method of controlling the sequence and timing of an externally powered weapon wherein said sequence includes the operations of ramming, firing, extracting and loading, and wherein said weapon includes a barrel, a bolt assembly and a feed assembly, the method comprising the steps of:

providing a control assembly including a driven member;

continuously advancing said driven member along a predetermined generally rectangular path of travel in one direction;

said path of travel including portions defining the sequence and time of the operations of ramming, firing, extracting and loading;

maintaining said bolt assembly in contact with said continuously advancing driven member throughout said sequence;

said bolt assembly in driving contact with said driven member being stationary during loading and firing operations while said driven member is continuously advanced along said predetermined path of travel;

selecting a round for firing among at least two types of rounds;

handing-off the selected round to a rotor assembly for subsequent indexing of said round to said bolt assembly, said round being handed-off at the last possible moment said rotor assembly may accept a round to allow maximum delay in selecting said round;

sequentially indexing said round to said bolt assembly during the loading operation as controlled by the relative position of said driven member along the path of travel; and the rate of travel and the length of the path of travel of said driven member determining the time interval of each of said operations.

13. A gun comprising:

a housing;

a single gun barrel having a longitudinal axis and disposed within said housing;

a single gun bolt disposed within said housing and journaled for reciprocation along said longitudinal axis;

an operating mechanism for said gun bolt;

means for feeding rounds of ammunition to and from said gun bolt; and coupling means for interengaging said operating mechanism and said feeding means;

wherein said feeding means comprises:

first transfer means, driven at a nonuniform and periodic rotational velocity by said coupling means, for advancing and accepting a train of rounds of ammunition at a substantially uniform rate, and second transfer means, driven at an intermittent angular velocity by said coupling means, for receiving a round of ammunition from said first transfer means and for translating said round transversely to said longitudinal axis to the face of the gun bolt said coupling means driving said first transfer means of said feeding means to delay transfer of each said round from said first to said second transfer means.

14. A gun according to claim 13 wherein:

said first transfer means is driven at a substantially cycloidal angular velocity by said coupling means.

15. An ammunition feeder for a gun having a longitudinally reciprocating gun bolt, including:

first transfer means, driven at a substantially nonuniform and periodic rotational velocity, for accepting and advancing a train of rounds of ammunition at a substantially uniform rate;

second transfer means, driven at an intermittent rotational velocity, for initially receiving a round of ammunition from said first transfer means and for transversely translating such round to the face of the gun bolt of the gun and for subsequently ejecting such round after firing from the face of the gun bolt; and drive means directly coupled both to said first transfer means and to said second transfer means for positively driving said first transfer means and said second transfer means, said drive means driving said first and second transfer means to delay transfer of each said round from said first transfer means to said second transfer means.

16. An ammunition feeder for a gun having a longitudinally reciprocating gun bolt, including:

housing means;

first rotating sprocket means, disposed in said housing means, and driven at a nonuniform and periodic rotational velocity, for accepting and advancing a train of rounds of ammunition at a substantially uniform rate; and second rotating sprocket means, disposed in said housing means, and driven at an intermittent rotational velocity for initially receiving a round of ammunition from said first sprocket means and for transversely translating such round to the face of the gun bolt of the gun and for subsequently ejecting such round after firing from the face of the gun bolt said first sprocket means handing-off each round to said second sprocket means, and means for driving said first sprocket means to delay handing-off each round from said first sprocket means to said second sprocket means for a predetermined interval.

* * * * *